US010151012B2

(12) United States Patent
Eguchi et al.

(10) Patent No.: US 10,151,012 B2
(45) Date of Patent: Dec. 11, 2018

(54) HIGH-STRENGTH STAINLESS STEEL PIPE

(71) Applicant: JFE STEEL CORPORATION, Tokyo (JP)

(72) Inventors: Kenichiro Eguchi, Tokyo (JP); Yasuhide Ishiguro, Tokyo (JP); Takeshi Suzuki, Tokyo (JP); Hideo Sato, Tokyo (JP); Tetsu Nakahashi, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 292 days.

(21) Appl. No.: 14/916,265

(22) PCT Filed: Aug. 4, 2014

(86) PCT No.: PCT/JP2014/004056
§ 371 (c)(1),
(2) Date: Mar. 3, 2016

(87) PCT Pub. No.: WO2015/033518
PCT Pub. Date: Mar. 12, 2015

(65) Prior Publication Data

US 2016/0215359 A1 Jul. 28, 2016

(30) Foreign Application Priority Data

Sep. 4, 2013 (JP) ..... 2013-183036

(51) Int. Cl.

| | |
|---|---|
| ***C22C 38/44*** | (2006.01) |
| ***C22C 38/46*** | (2006.01) |
| ***C22C 38/48*** | (2006.01) |
| ***C22C 38/50*** | (2006.01) |
| ***C21D 9/08*** | (2006.01) |
| ***C22C 38/00*** | (2006.01) |
| ***C22C 38/58*** | (2006.01) |
| ***C21D 6/00*** | (2006.01) |
| ***C21D 9/14*** | (2006.01) |
| ***C21D 8/10*** | (2006.01) |
| ***C22C 38/40*** | (2006.01) |
| ***C22C 38/42*** | (2006.01) |
| ***C22C 38/54*** | (2006.01) |
| ***B21B 19/04*** | (2006.01) |
| ***B21C 23/00*** | (2006.01) |
| ***B22D 11/00*** | (2006.01) |
| ***C21D 1/18*** | (2006.01) |
| ***C21D 1/613*** | (2006.01) |
| ***C22C 38/02*** | (2006.01) |
| ***C22C 38/04*** | (2006.01) |
| ***C22C 38/06*** | (2006.01) |

(52) U.S. Cl.

CPC ..... *C21D 9/08* (2013.01); *B21B 19/04* (2013.01); *B21C 23/002* (2013.01); *B22D 11/002* (2013.01); *C21D 1/18* (2013.01); *C21D 1/613* (2013.01); *C21D 6/004* (2013.01); *C21D 6/005* (2013.01); *C21D 6/008* (2013.01); *C21D 8/105* (2013.01); *C21D 9/14* (2013.01); *C22C 38/00* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/40* (2013.01); *C22C 38/42* (2013.01); *C22C 38/44* (2013.01); *C22C 38/46* (2013.01); *C22C 38/48* (2013.01); *C22C 38/50* (2013.01); *C22C 38/54* (2013.01); *C22C 38/58* (2013.01); *C21D 8/10* (2013.01); *C21D 9/085* (2013.01); *C21D 2211/001* (2013.01); *C21D 2211/004* (2013.01); *C21D 2211/005* (2013.01); *C21D 2211/008* (2013.01)

(58) Field of Classification Search
None
See application file for complete search history.

(56) References Cited

U.S. PATENT DOCUMENTS

2006/0243354 A1 11/2006 Kimura
2014/0041770 A1* 2/2014 Hashizume ..... C22C 38/001 148/609

FOREIGN PATENT DOCUMENTS

| | | |
|---|---|---|
| CN | 1836056 | 9/2006 |
| EP | 1179380 | 2/2002 |
| EP | 1683885 A1 | 7/2006 |
| EP | 2341161 | 7/2011 |
| EP | 2728030 A1 | 5/2014 |

(Continued)

OTHER PUBLICATIONS

Machine-English translation of JP 2008-081793, Kimura Mitsuo et al., Sep. 28, 2006.*
Extended European Search Report for European Application No. 14842892.3, dated Aug. 2, 2016, 15 pages.
Gooch, T.G., "Heat treatment of welded 13%Cr-4%Ni martensitic stainless steels for sour service," Jul. 31, 1995, pp. 213s-223s, Supplement to the Welding Journal, Sponsored by the American Welding Society and Welding Research Council, Retrieved from the Internet: URL:https://app.aws.org/wj/supplement/WJ_1995_07_S213.pdf [retrieved on Jul. 18, 2016].

(Continued)

*Primary Examiner* — Deborah Yee
(74) *Attorney, Agent, or Firm* — RatnerPrestia

(57) ABSTRACT

A method of manufacturing a high-strength stainless steel pipe includes forming a steel pipe having a predetermined size, the steel having a composition comprising by mass % 0.005 to 0.05% C, 0.05 to 1.0% Si, 0.2 to 1.8% Mn, 0.03% or less P, 0.005% or less S, 14 to 20% Cr, 1.5 to 10% Ni, 1 to 5% Mo, 0.5% or less V, 0.15% or less N, 0.01% or less O, 0.002 to 0.1% Al, and Fe and unavoidable impurities as a balance; applying a quenching treatment two times or more to the steel pipe where the steel pipe is quenched by reheating to a temperature of 750° C. or above and cooling to a temperature of 100° C. or below at a cooling rate equal to or higher than an air-cooling rate; and applying a tempering treatment where the steel pipe is tempered at a temperature of 700° C. or below.

2 Claims, No Drawings

(56) References Cited

FOREIGN PATENT DOCUMENTS

| | | | |
|---|---|---|---|
| EP | 2749664 | | 7/2014 |
| EP | 2796587 | | 10/2014 |
| JP | 63100125 | | 5/1988 |
| JP | 285340 | | 3/1990 |
| JP | 2682332 | | 11/1997 |
| JP | H1161267 | | 3/1999 |
| JP | 2000160300 | A | 6/2000 |
| JP | 2001140040 | | 5/2001 |
| JP | 2001279392 | | 10/2001 |
| JP | 2005336595 | | 12/2005 |
| JP | 2005336599 | A | 12/2005 |
| JP | 2007332431 | | 12/2007 |
| JP | 2008081793 | | 4/2008 |
| JP | 2012149317 | | 8/2012 |
| JP | 2012193404 | | 10/2012 |
| JP | 2013032584 | A | 2/2013 |
| WO | 2013002418 | A1 | 1/2013 |
| WO | 2013027666 | | 2/2013 |
| WO | 2013094179 | | 6/2013 |

OTHER PUBLICATIONS

Chinese Office Action for Chinese Application No. 201480048919.6, dated Jan. 26, 2018, including Concise Statement of Relevance of Office Action, 7 pages.

International Search Report for International Application No. PCT/JP2014/004056 dated Oct. 7, 2014.

Written Opinion of the International Searching Authority for International Application No. PCT/JP2014/004056 dated Oct. 7, 2014.

Chinese Office Action with partial English language translation for Application No. 201480048919.6, dated Jul. 13, 2017, 8 pages.

Chinese Office Action dated Sep. 30, 2016 for Chinese Application No. 201480048919.6, including Concise Statement of Search Report, 19 pages.

European Communication for European Application No. 14 842 892.3, dated Sep. 14, 2017, 6 pages.

"Standard specification for forged or rolled alloy-steel pipe flanges, forged fittings, and valves and parts for high-temperature service," Jan. 2000, pp. 1-16, ASTM Designation: A 182/A 182M-99, An American National Standard Endorsed by Manufacturers Standardization Society of the Valve & Fittings Industry used in USDOE-NE Standards, Retrieved from the Internet: URL:http://www.cnpipefitting.com/downloads/ASTM%20A182%20A182M-99.pdf.

Japanese Office Action with partial English language translation for Application No. JP 2014-158363, dated Aug. 25, 2015, 6 pages.

European Communication for European Application No. 14 842 892.3, dated May 23, 2018, 6 pages.

* cited by examiner

HIGH-STRENGTH STAINLESS STEEL PIPE

CROSS-REFERENCE TO RELATED APPLICATIONS

This is the U.S. National Phase application of PCT International Application No. PCT/JP2014/004056, filed Aug. 4, 2014, and claims priority to Japanese Patent Application No. 2013-183036, filed Sep. 4, 2013, the disclosures of each of these applications being incorporated herein by reference in their entireties for all purposes.

FIELD OF THE INVENTION

The present invention relates to a method of manufacturing a high-strength stainless steel seamless tube or pipe for Oil Country Tubular Goods made of 17% Cr stainless steel pipe having mainly two phases, that is, a martensite phase and a ferrite phase, and a high-strength stainless steel pipe manufactured by such a manufacturing method. Here, "high-strength" means a yield strength of 758 MPa or more.

BACKGROUND OF THE INVENTION

Recently, to cope with the skyrocketing oil price and the exhaustion of petroleum predicted in near future, there have been globally reinvestigated, the deep layer oil wells which have not been noticed or the highly corrosive sour gas fields development of which have been abandoned once. Such oil fields or gas fields lie extremely deep in general and have high-temperature atmospheres containing carbon dioxide gas ($CO_2$), chloride ion ($Cl^-$) and the like, which are severe corrosive environments. Accordingly, as Oil Country Tubular Goods used for drilling in such oil fields and gas fields, there has been a demand for a steel pipe which has corrosion resistance as well as high strength. Recently, there has been developed a 17% Cr stainless steel having mainly two phases, that is, a martensite phase and a ferrite phase, which is applicable in such a severe environment.

Recently, the development of oil fields in cold areas has been actively pursued and hence, the demand for a steel pipe to have excellent low-temperature toughness in addition to high strength has been increased. Accordingly, there has been a strong request for inexpensive high-strength steel pipes for Oil Country Tubular Goods having excellent hot workability, excellent carbon dioxide-corrosion resistance, and high toughness.

For example, Patent Literature 1 discloses "a high-strength martensitic stainless steel seamless pipe for Oil Country Tubular Goods excellent in carbon dioxide-corrosion resistance and sulfide stress corrosion cracking resistance, having a composition comprising by mass % 0.01% or less C, 0.5% or less Si, 0.1 to 2.0% Mn, 0.03% or less P, 0.005% or less S, more than 15.5% to 17.5% or less Cr, 2.5 to 5.5% Ni, 1.8 to 3.5% Mo, 0.3 to 3.5% Cu, 0.20% or less V, 0.05% or less Al, and 0.06% or less N, and a tensile characteristic (yield strength: 655 to 862 MPa and yield ratio: 0.90 or more) after quenching and tempering, wherein the microstructure contains 15% or more of ferrite phase by volume or further contains 25% or less of residual austenite phase by volume, and a tempered martensite phase as a balance".

Patent Literature 2 discloses "a high-strength stainless steel pipe for Oil Country Tubular Goods having a composition comprising by mass % 0.005 to 0.05% C, 0.05 to 0.5% Si, 0.2 to 1.8% Mn, 0.03% or less P, 0.005% or less S, 15.5 to 18% Cr, 1.5 to 5% Ni, 1 to 3.5% Mo, 0.02 to 0.2% V, 0.01 to 0.15% N, 0.006% or less O, and Fe and unavoidable impurities as a balance under the condition that the relationship of $Cr+0.65Ni+0.6Mo+0.55Cu-20C \geq 19.5$ and the relationship of $Cr+Mo+0.3Si-43.5C-0.4Mn-Ni-0.3Cu-9N \geq 11.5$ are satisfied, and a microstructure containing, preferably a martensite phase as a base phase, 10 to 60% of ferrite phase by volume or further containing 30% or less of austenite phase by volume by preferably applying quenching and tempering, wherein the YS exceeds 654 MPa and the excellent carbon dioxide-corrosion resistance is obtained even in a severe high-temperature corrosive environment (up to 230° C.) containing $CO_2$, $Cl^-$ and the like".

Patent Literature 3 discloses "an inexpensive high-strength stainless steel pipe for Oil Country Tubular Goods having a composition comprising by mass % 0.04% or less C, 0.50% or less Si, 0.20 to 1.80% Mn, 0.03% or less P, 0.005% or less S, 15.5 to 17.5% Cr, 2.5 to 5.5% Ni, 0.20% or less V, 1.5 to 3.5% Mo, 0.50 to 3.0% W, 0.05% or less Al, 0.15% or less N, and 0.006% or less O under the condition that three following formulae ($Cr+3.2Mo+2.6W-10C \geq 23.4$, $Cr+Mo+0.5W+0.3Si-43.5C-0.4Mn-0.3Cu-Ni-9N \geq 11.5$, and $2.2 \leq Mo+0.8W \leq 4.5$) are simultaneously satisfied, and a microstructure containing, preferably a martensite phase as a base phase, 10 to 50% of ferrite phase by volume by preferably applying quenching and tempering, wherein the YS exceeds 654 MPa and the excellent carbon dioxide-corrosion resistance is obtained in a severe high-temperature corrosive environment containing $CO_2$, $Cl^-$ and the like at 170° C. or above, and further the excellent SSC resistance and the high toughness are obtained even in a $H_2S$ containing environment".

CITATION LIST

Patent Literature

PTL 1: JP-A-2012-149317
PTL 2: JP-A-2005-336595
PTL 3: JP-A-2008-81793

SUMMARY OF THE INVENTION

The microstructure of the stainless steel pipes described in either of Patent Literatures 1 to 3 contains a martensite phase, a ferrite phase and a residual austenite phase, and a volume percentage of the ferrite phase is set to 10 to 50%, or 10 to 60%. In such a two-phase type steel which is substantially made of a martensite phase and a ferrite phase, the ferrite phase is present in a temperature range from a high temperature to a low temperature so that the grain refining of the ferrite phase brought about by phase transformation cannot be expected. Conventionally, in such a type of steel, the toughness is ensured due to grain refining by applying pressing force (plastic forming) to the material steel by hot rolling.

In either of embodiments of Patent Literatures 1 to 3, only the case has been disclosed where quenching and tempering are performed one time as a heat treatment with respect to a stainless steel seamless pipe having an outer diameter of 3.3 inches (83.8 mm) and a wall thickness of 0.5 inches (12.7 mm). However, none of these Patent Literatures 1 to 3 describes a specific rolling method. It is considered that the toughness of the stainless steel seamless pipes described in these Patent Literatures is ensured due to grain refining of ferrite phase by controlling the rolling reduction in hot rolling.

On the other hand, in the case of a stainless steel seamless pipe, the rolling reduction in hot rolling cannot be ensured in manufacturing a heavy wall pipe (mostly a steel pipe having a wall thickness of 1 inch or more), and hence, a coarse ferrite phase is present in the microstructure thus giving rise to a drawback that the toughness of the material stainless steel is deteriorated.

Aspects of the present invention have been made to overcome the above-mentioned drawback, and it is an object of aspects of the present invention to provide a method of manufacturing a high-strength stainless steel pipe having excellent toughness by using 17% Cr steel which allows a microstructure to be composed of mainly two phases, that is, a martensite phase and a ferrite phase as a starting material.

The 17% Cr steel is a material which exhibits excellent strength and excellent corrosion resistance. The microstructure of the 17% Cr steel is mainly composed of a martensite phase and a ferrite phase, and the ferrite phase is a delta ferrite phase which is generated at a high temperature. Accordingly, the grain refining of the ferrite phase by heat treatment is difficult, and when a cumulative rolling reduction ratio in hot rolling is small, a coarse ferrite phase is present in a network form after hot rolling thus giving rise to a drawback that the low-temperature toughness is deteriorated.

In view of the above, the inventors of the present invention have made extensive studies to overcome the drawback concerning the toughness, and have found that even in 17% Cr steel having mainly two phases, that is, a martensite phase and a ferrite phase, it is possible to enhance the toughness due to the modification of the microstructure by performing plural times of heat treatments.

Aspects of the present invention have been made as a result of the further studies based on the above-mentioned findings, and aspects of the present invention include the following.

(1) A method of manufacturing a high-strength stainless steel pipe, characterized by comprising;

forming a steel into a steel pipe having a predetermined size, the steel having a composition comprising by mass % 0.005 to 0.05% C, 0.05 to 1.0% Si, 0.2 to 1.8% Mn, 0.03% or less P, 0.005% or less S, 14 to 20% Cr, 1.5 to 10% Ni, 1 to 5% Mo, 0.5% or less V, 0.15% or less N, 0.01% or less O, 0.002 to 0.1% Al, and Fe and unavoidable impurities as a balance, applying a quenching treatment two times or more to the steel pipe where the steel pipe is quenched by reheating to a temperature of 750° C. or above and cooling to a temperature of 100° C. or below at a cooling rate equal to or above an air-cooling rate, the final quenching treatment among the quenching treatments being performed by reheating to a temperature at which $\chi$ phase and $M_{23}C_6$ precipitate or above, and applying a tempering treatment where the steel pipe is tempered at a temperature of 700° C. or below.

(2) A method of manufacturing a high-strength stainless steel pipe, characterized by comprising;

forming a steel into a steel pipe having a predetermined size, the steel having a composition comprising by mass % 0.005 to 0.05% C, 0.05 to 1.0% Si, 0.2 to 1.8% Mn, 0.03% or less P, 0.005% or less S, 14 to 20% Cr, 1.5 to 10% Ni, 1 to 5% Mo, 0.5% or less V, 0.15% or less N, 0.01% or less O, 0.002 to 0.1% Al, and Fe and unavoidable impurities as a balance, and applying a quenching treatment followed by a tempering treatment two times or more to the steel pipe where the steel pipe is quenched by reheating to a temperature of 750° C. or above and cooling to a temperature of 100° C. or below at a cooling rate equal to or above an air-cooling rate, and tempered at a temperature of 700° C. or below, the final quenching treatment among the quenching treatments being performed by reheating to a temperature at which $\chi$ phase and $M_{23}C_6$ precipitate or above.

(3) The method of manufacturing a high-strength stainless steel pipe described in (1) or (2), characterized in that when the quenching treatment is applied two times or more, the reheating temperature is set at least at two different levels.

(4) The method of manufacturing a high-strength stainless steel pipe described in any one of (1) to (3), characterized in that the composition of the steel further contains by mass % at least one selected from 3.5% or less Cu and 3% or less W.

(5) The method of manufacturing a high-strength stainless steel pipe described in any one of (1) to (4), characterized in that the composition of the steel further contains by mass % at least one selected from 0.5% or less Nb, 0.3% or less Ti and 0.01% or less B.

(6) The method of manufacturing a high-strength stainless steel pipe described in any one of (1) to (5), characterized in that the composition of the steel further contains by mass % at least one selected from 0.01% or less Ca, 0.01% or less REM and 0.2% or less Zr.

(7) A high-strength stainless steel pipe, characterized by being manufactured by the manufacturing method described in any one of (1) to (6).

(8) A high-strength stainless steel pipe, characterized by having;

a composition containing by mass % 0.005 to 0.05% C, 0.05 to 1,0% Si, 0.2 to 1.8% Mn 0.03% or less P, 0.005% or less S. 14 to 20% Cr, 1.5 to 10% Ni, 1 to 5% Mo, 0.5% or less V, 0.15% or less N, 0.01% or less 0, 0.002 to 0.1% Al, and Fe and unavoidable impurities as a balance, a thickness of 19.1 mm or more, a Charpy absorbed energy of 30 J or more at a temperature of −10° C., and a sulfide stress corrosion cracking resistance, wherein a specimen is not broken for 720 hours or more in a sulfide stress corrosion cracking test which is performed under a condition where a specimen cut out from the high-strength stainless steel pipe conforming to a provision of an ACE-TM0177 Method A is soaked into an aqueous solution prepared by adding an acetic acid and sodium acetate to 20 mass % NaCl aqueous solution (in an atmosphere where a liquid temperature is 20° C., $H_2S$ is at 0.1 atm and $CO_2$ is at 0.9 atm) and controlling a pH value thereof to 3.5, and an applied stress is 90% of a yield stress.

(9) The high-strength stainless steel pipe described in (8), characterized in that an average grain size of martensite is 5 μm or below.

(10) The high-strength stainless steel pipe described in (8) or (9), characterized in that the composition further contains W, and the microstructure has a ferrite-martensite interface, wherein each content of Mo and W in the ferrite-martensite interface is three or more times as large as each content of Mo and W of the steel seamless pipe.

(11) The high-strength stainless steel pipe described in any one of (8) to (10), characterized in that the composition further contains by mass % at least one selected from 3.5% or less Cu and 3% or less W.

(12) The high-strength stainless steel pipe described in any one of (8) to (11), characterized in that the composition further contains by mass % at least one selected from 0.5% or less Nb, 0.3% or less Ti and 0.01% or less B.

(13) The high-strength stainless steel pipe described in any one of (8) to (12), characterized in that the composition further contains by mass % at least one selected from 0.01% or less Ca, 0.01% or less REM and 0.2% or less Zr.

By applying a heat treatment method according to aspects of the present invention to a 17% Cr stainless steel seamless pipe having a heavy wall thickness, it is possible to obtain a high-strength stainless steel pipe excellent in toughness.

DETAILED DESCRIPTION OF EMBODIMENTS OF THE INVENTION

Hereinafter, the reasons for limiting respective conditions of aspects of the present invention are explained. It is needless to say that the present invention is not limited to the embodiment described hereinafter.

1. Composition

Firstly, the reason for limiting the composition of the high-strength stainless steel pipe according to aspects of the present invention is explained. In this specification, unless otherwise specified, "%" used for a component means "mass %". The composition of the steel pipe before a treatment such as reheating and the composition of the high-strength stainless steel pipe according to aspects of the present invention are substantially unchanged, thus the technical significances with respect to the composition limitations are common to both pipes.

C: 0.005 to 0.05%

C is an important element relating to corrosion resistance and strength. From a viewpoint of corrosion resistance, it is preferable to decrease the content of C as small as possible. However, from a viewpoint of ensuring strength, it is necessary to contain 0.005% or more C. On the other hand, when the content of C exceeds 0.05%, Cr carbides are increased so that Cr in solid solution which effectively functions to improve corrosion resistance is decreased. Accordingly, the content of C is set to 0.005 to 0.05%. The content of C is preferably 0.005 to 0.030%.

Si: 0.05 to 1.0%

Si is added for deoxidization. When the content of Si is less than 0.05%, a sufficient deoxidizing effect cannot be obtained, and when the content of Si exceeds 1.0%, carbon dioxide-corrosion resistance and hot workability are deteriorated. Accordingly, the content of Si is set to 0.05 to 1.0%. The content of Si is preferably 0.1 to 0.6%, more preferably 0.1 to 0.4%.

Mn: 0.2 to 1.8%

Mn is added from a viewpoint of ensuring strength of abase steel. When the content of Mn is less than 0.2%, a sufficient effect of added Mn cannot be obtained. When the content of Mn exceeds 1.8%, toughness is deteriorated. Accordingly, the content of Mn is set to 0.2 to 1.8%. The content of Mn is preferably 0.2 to 1.0%, more preferably 0.2 to 0.7%.

P: 0.03% or Less

When the content of P exceeds 0.03%, both toughness and sulfide stress corrosion cracking resistance are deteriorated. Accordingly, the content of P is set to 0.03% or less. The content of P is preferably 0.02% or less.

S: 0.005% or Less

When the content of S exceeds 0.005%, both toughness and hot workability of a base steel are deteriorated. Accordingly, the content of S is set to 0.005% or less. The content of S is preferably 0.003% or less.

Cr: 14 to 20%

Cr is an element which enhances corrosion resistance by forming a protective surface film. Particularly, Cr contributes to the enhancement of carbon dioxide-corrosion resistance and sulfide stress corrosion cracking resistance. Such an advantageous effect is confirmed when the content of Cr is set to 14% or more. When the content of Cr exceeds 20%, austenite phase and ferrite phase are increased and hence, desired high strength cannot be maintained, and toughness and hot workability are also deteriorated. Accordingly, the content of Cr is set to 14 to 20%. The content of Cr is preferably 15 to 19%, more preferably 16 to 18%.

Ni: 1.5 to 10%

Ni is an element which has a function of enhancing carbon dioxide-corrosion resistance, pitting corrosion resistance and sulfide stress corrosion cracking resistance by strengthening a protective surface film. Further, Ni increases strength of steel by solute strengthening. Such advantageous effects are confirmed when the content of Ni is set to 1.5% or more. When the content of Ni exceeds 10%, desired high strength cannot be obtained, and hot workability is also deteriorated. Accordingly, the content of Ni is set to 1.5 to 10%. The content of Ni is preferably 2 to 8%, more preferably 3 to 6%.

Mo: 1 to 5%

Mo is an element which increases resistance to pitting corrosion caused by $Cl^-$ ions. Such an advantageous effect is confirmed when the content of Mo is set to 1% or more. When the content of Mo exceeds 5%, austenite phase and ferrite phase are increased and hence, desired high strength cannot be maintained, and toughness and hot workability are also deteriorated. Further, when the content of Mo exceeds 5%, intermetallic compounds are precipitated so that toughness and sulfide stress corrosion cracking resistance are deteriorated. Accordingly, the content of Mo is set to 1 to 5%. The content of Mo is preferably 1.5 to 4.5%, more preferably 2 to 4%.

V: 0.5% or Less is an element which enhances strength of steel by precipitation strengthening and, further, improves sulfide stress corrosion cracking resistance. Accordingly, it is preferable to set the content of V to 0.02% or more. However, when the content of V exceeds 0.5%, toughness is deteriorated. Accordingly, the content of V is set to 0.5% or less. The content of V is preferably 0.03 to 0.3%.

N: 0.15% or Less

N is an element which enhances pitting corrosion resistance. Such an advantageous effect becomes apparent when the content of N is set to 0.01% or more. On the other hand, when the content of N exceeds 0.15%, various kinds of nitrides are formed so that toughness is deteriorated. Accordingly, the content of N is set to 0.15% or less. The content of N is preferably 0.13% or less, more preferably 0.1% or less.

O: 0.01% or Less

O is present in steel in the form of oxides, and exerts an adverse effect on various kinds of properties and hence, it is preferable to decrease the content of O as small as possible for enhancing the properties. Particularly, when the content of O exceeds 0.01%, hot workability, corrosion resistance, sulfide stress corrosion cracking resistance, and toughness are remarkably deteriorated. Accordingly, the content of O is set to 0.01% or less. The content of O is preferably 0.008% or less, more preferably 0.006% or less.

Al: 0.002 to 0.1%

Al is added for sufficiently deoxidizing molten steel. When the content of Al is less than 0.002%, a sufficient deoxidization effect is not obtained, while when the content of Al exceeds 0.1%, Al dissolved into a base steel in solid solution is increased so that toughness of the base steel is deteriorated. Accordingly, the content of Al is set to 0.002 to 0.1%. The content of Al is preferably 0.01 to 0.07%, more preferably 0.02 to 0.06%.

The above-mentioned composition is a basic chemical composition of an aspect of the present invention, and the balance is Fe and unavoidable impurities. The high-strength stainless steel pipe may further contain, as a selective element, at least one element selected from Cu and W for the purpose of enhancing stress corrosion cracking resistance.

Cu: 3.5% or Less

Cu is an element which suppresses the intrusion of hydrogen into steel by strengthening a protective surface film, thus enhancing sulfide stress corrosion cracking resistance. In accordance with aspects of the present invention, it is preferable to set the content of Cu to 0.3% or more. However, when the content of Cu exceeds 3.5%, grain boundary precipitation of CuS is induced so that hot workability is deteriorated. Accordingly, when the steel seamless pipe contains Cu, the content of Cu is preferably set to 3.5% or less. The content of Cu is more preferably 0.5 to 2.5%.

W: 3% or Less

W contributes to the enhancement of strength of steel, and further enhances sulfide stress corrosion cracking resistance. Accordingly, it is preferable to set the content of W to 0.5% or more. However, when the content of W exceeds 3%, $\chi$ phase is precipitated so that toughness and corrosion resistance are deteriorated. Accordingly, when the steel seamless pipe contains W, the content of W is preferably set to 3% or less. The content of W is more preferably 0.5 to 2%.

The high-strength stainless steel pipe of an aspect of the present invention may further contain, in addition to the above-mentioned composition, at least one element selected from Nb, Ti and B for the purpose of increasing strength as a selective element.

Nb: 0.5% or Less

Nb contributes to the increase of strength and the enhancement of toughness of steel and hence, it is preferable to set the content of Nb to 0.02% or more. However, when the content of Nb exceeds 0.5%, toughness is deteriorated. Accordingly, when the steel pipe contains Nb, the content of Nb is preferably set to 0.5% or less. The content of Nb is more preferably 0.03 to 0.3%.

Ti: 0.3% or Less

Ti contributes to the enhancement of strength of steel and, further, contributes to the improvement of sulfide stress corrosion cracking resistance and hence, it is preferable to set the content of Ti to 0.02% or more. However, when the content of Ti exceeds 0.3%, coarse precipitates are generated so that toughness and sulfide stress corrosion cracking resistance are deteriorated. Accordingly, when the steel pipe contains Ti, the content of Ti is preferably set to 0.3% or less. The content of Ti is more preferably 0.03 to 0.1%.

B: 0.01% or Less

B contributes to the enhancement of strength of steel and, further, contributes to the improvement of sulfide stress corrosion cracking resistance and hot workability and hence, it is preferable to set the content of B to 0.0005% or more. However, the content of B exceeds 0.01%, toughness and hot workability is deteriorated. Accordingly, when the steel pipe contains B, the content of B is preferably set to 0.01% or less. The content of B is more preferably 0.001 to 0.004%.

The high-strength stainless steel pipe of an aspect of the present invention may further contain, in addition to the above-mentioned composition, at least one element selected from Ca, REM, and Zr for the purpose of improving the material properties.

Ca: 0.01% or Less, REM: 0.01% or Less, Zr: 0.2% or Less

Ca, REM and Zr are elements all of which contribute to the improvement of sulfide stress corrosion cracking resistance. The high-strength stainless steel pipe can selectively contain these elements when necessary. To obtain such an advantageous effect, the content of Ca is preferably set to 0.001% or more, the content of REM is preferably set to 0.001% or more, and the content of Zr is preferably set to 0.001% or more. However, even when high-strength stainless steel pipe contains Ca exceeding 0.01%, REM exceeding 0.01% and Zr exceeding 0.2%, the advantageous effect is saturated, and cleanness in steel is remarkably lowered so that toughness is deteriorated. Accordingly, when the steel pipe contains these elements, the content of Ca is preferably set to 0.01% or less, the content of REM is preferably set to 0.01% or less, and the content of Zr is preferably set to 0.2% or less.

2. Manufacturing Method

Hereinafter, manufacturing method according to aspects of the present invention will be described.

The method of manufacturing a high-strength stainless steel pipe according to aspects of the present invention, particularly, a heat treatment method is explained. In accordance with aspects of the present invention, firstly, a stainless steel pipe having the above-mentioned composition is formed and, thereafter, the steel pipe is cooled to a room temperature at a cooling rate which is equal to or higher than an air-cooling rate. The steel pipe thus produced is used as a starting material in aspects of the present invention. A method of producing the steel pipe as a starting material is not particularly limited, and a known method of manufacturing a steel seamless pipe or a known method of manufacturing an electric resistance welded steel pipe is applicable to the starting material in aspects of the present invention. For example, the material for the steel pipe such as a billet is preferably produced as follows. Molten steel having the above-mentioned composition is made by a conventional steel making method using such as a converter, and a steel billet is formed from the molten steel by a conventional method such as a continuous casting method or an ingot-blooming method. Then, the material for the steel pipe is heated and is formed into a steel pipe at heated state by a Mannesmann-plug mill process or a Mannesmann-mandrel mill process either of which is conventionally-known pipe producing process, and thus a stainless steel pipe having the above-mentioned composition and having a desired size is produced. The stainless steel pipe may be produced by press-type hot extrusion to produce a seamless pipe. Further, in the case of electric resistance welded steel pipe, the material for the steel pipe maybe produced by a usual well-known method, and formed into steel pipe by a usual well-known method to obtain the electric resistance welded steel pipe.

Quenching Treatment

The stainless steel pipe as a starting material is reheated to a temperature of 750° C. or above and is held at the reheated temperature (holding time (soaking time): 20 minutes) and, thereafter, the stainless steel pipe is cooled to a temperature of 100° C. or below at a cooling rate equal to or above an air cooling rate.

Since it is necessary to reversely transform martensite to austenite, the reheating temperature is set to 750° C. or above. Further, it is preferable to set the reheating temperature to 1100° C. or below for preventing the microstructure from becoming coarse. Further, it is preferable to set a holding time to 5 minutes or more from a viewpoint of thermal homogeneity, and it is more preferable to set a holding time to 120 minutes or less from a viewpoint of preventing the microstructure from becoming coarse.

The reason that the cooling rate after reheating and holding is set equal to or above an air cooling rate is to generate martensite transformation by preventing the precipitation of carbo-nitrides or intermetallics in a cooling step. The reason that the cooling stop temperature is set to 100° C. or below is to obtain an amount of martensite necessary for achieving a desired strength.

The microstructure obtained in this quenched state exhibits two phases consisting of a martensite phase and a ferrite phase where χ phase which impairs toughness is present as precipitates, and 30 volume % or less of residual austenite (γ) may be present in the microstructure.

In accordance with aspects of the present invention, quenching treatment is repeatedly performed. That is, in aspects of the present invention, quenching treatment is performed plural times. With respect to such the quenching treatment performed plural times, it is preferable that quenching treatment is performed plural times under the condition that quenching heating temperature (quenching temperature) is changed at 2 different levels or more rather at each quenching treatment than the case where every quenching treatment is performed under the same condition. This is because a ferrite percentage in equilibrium differs depending on the respective levels of quenching treatments so that the formation of ferrite or the formation of austenite takes place so as to reach an equilibrium state corresponding to the respective levels of treatments whereby the generated microstructure is refined. A quenching temperature for any one of second and succeeding quenching treatments is set at a temperature at which χ phase and $M_{23}C_6$ (M=Fe, Mo, Cr) disappear or above. The preferred quenching temperature in second and succeeding quenching treatments is set to 960° C. to 1060° C. For example, in any one of second and succeeding quenching treatments, the stainless steel pipe is reheated to and is held at 960° C. to 1060° C. and, thereafter, cooled to 100° C. or below at a cooling rate equal to or above an air cooling rate. By performing second quenching, residual γ may be present in a base 2 phase microstructure formed of martensite and ferrite. This treatment corresponds to "treatment performed at a temperature exceeding a temperature at which χ phase and $M_{23}C_6$ are dissolved" and hence, this treatment may be a final quenching treatment.

The toughness is further enhanced by repeating quenching treatment two times or more. Because of the reason that the presence of χ phase and $M_{23}C_6$ adversely affects the toughness and SSC resistance, the final quenching treatment is performed at a temperature exceeding a temperature at which χ phase and $M_{23}C_6$ are dissolved.

Tempering treatment is performed for imparting toughness to the high-strength stainless steel pipe.

By tempering treatment, the microstructure contains a martensite phase, a ferrite phase and a small amount (30% or less) of residual austenite phase. As a result, it is possible to acquire a high-strength stainless steel pipe having a desired strength, high toughness and excellent corrosion resistance. When a tempering temperature exceeds a temperature as high as $Ac_1$ point, a martensite phase in a quenched state is generated so that a desired high strength, high toughness and excellent corrosion resistance are not ensure and hence, the tempering temperature is set to 700° C. or below. It is preferable to set the tempering temperature to 500° C. or above from a viewpoint of toughness and SSC resistance.

Timing at which tempering treatment is performed comes after quenching treatments repeated two times or more (that is, after the final quenching treatment) or after each quenching treatment (that is, treatment is repeated two times or more in order of quenching treatment and tempering treatment).

The high-strength stainless steel pipe obtained by the above-mentioned manufacturing method is explained.

3. High-Strength Stainless Steel Pipe

The high-strength stainless steel pipe has the same composition as a starting material. Accordingly, the composition of the high-strength stainless steel pipe can be adjusted by adjusting the composition of the steel as starting material.

To allow the high-strength stainless steel pipe of aspects of the present invention to ensure the high strength, the microstructure has two phases, that is, a martensite phase and a ferrite phase. To enhance corrosion resistance and to ensure hot workability, the microstructure includes mainly two phases of martensite and ferrite, and contains 10 to 60 volume % of ferrite phase. This is because when the ferrite phase is less than 10 volume %, the hot workability is deteriorated, while when the ferrite phase exceeds 60 volume %, the strength is lowered. The volume % of ferrite phase is preferably set to 15 to 50 volume %. As a second phase other than a ferrite phase, 30 volume % or less of residual austenite phase may be contained. Since χ phase (chi phase) adversely affects toughness and SSC resistance (sulfide stress corrosion cracking resistance), it is preferable to set an amount of χ phase as small as possible. In accordance with aspects of the present invention, an allowable amount of χ phase is 1 volume % or less.

From a viewpoint of enhancing toughness, it is preferable to set an average grain size of martensite to 6.0 μm or less. An EBSD method is used as a method of measuring an average grain size of martensite. Grains which have orientation difference of 15 or more degrees measured by EBSD method are also recognized as one grain, and the average grain size is obtained by weighting with an area of each grain.

The above-mentioned microstructure may preferably have a ferrite-martensite interface. From a viewpoint of enhancing toughness, it is preferable that the content of Mo in the interface is three or more times as large as the content of Mo of the steel pipe.

Further, from a viewpoint of enhancing toughness, it is preferable that the content of W in the interface is three or more times as large as the content of W of the steel pipe.

The content of Mo and the content of W in the ferrite-martensite interface are obtained by measuring the interface by a method referred to as a quantitative analysis using an EDX under thin-film TEM observation.

The high-strength stainless steel pipe having the above-mentioned composition and microstructure has the following features.

The high-strength stainless steel pipe of aspects of the present invention may have 30 J or more of Charpy absorbed energy at a temperature of −10° C. Charpy absorbed energy is measured by a method in accordance with ISO148-1.

Further, the high-strength stainless steel pipe of an aspect of the present invention may have sulfide stress corrosion cracking resistance at which a specimen is not broken for 720 or more hours in the following sulfide stress corrosion cracking resistance test.

(Sulfide Stress Corrosion Cracking Resistance Test)

A sulfide stress corrosion cracking resistance test is performed under a condition where a specimen having a parallel portion of 25.4 mm and a diameter of 6.4 mm which is cut out from the high-strength stainless steel pipe is soaked in an aqueous solution prepared by adding an acetic acid and sodium acetate to 20 mass % NaCl aqueous solution (in an atmosphere with liquid temperature: 20° C., $H_2S$: 0.1 atmospheric pressure, $CO_2$: 0.9 atmospheric pressure) and controlling a pH value to 3.5, and an applied stress is 90% of a yield stress.

A high-strength stainless steel pipe of an aspect of the present invention may have a thickness of 19.1 mm or more.

The reason that toughness is improved by applying the above-mentioned heat treatment is considered as follows.

(a) Refining of Martensite

Due to the repeated quenching treatment, the martensite repeats the transformation to the austenite and the transformation to the martensite again and hence, the martensite microstructure is refined so that toughness is enhanced.

(b) Reduction of Amount of Ferrite

When a quenching temperature other than a final quenching temperature is lower than the final quenching temperature and a holding time (soaking time) for quenching is long, a ferrite percentage is lowered. When the holding time (soaking time) for quenching at the final quenching temperature is short, the ferrite percentage is held in a lowered state so that toughness is enhanced.

(c) Strengthening of Interface Between Martensite Phase and Ferrite Phase

When the quenching treatment temperature before the final quenching treatment falls within a temperature range where $\chi$ phase and $M_{23}C_6$ are precipitated, the above-mentioned precipitates precipitate in the interface between a martensite phase and a ferrite phase. By setting the final quenching temperature to a temperature at which $\chi$ phase disappears or more, the precipitates are dissolved. Here, $\chi$ phase and $M_{23}C_6$ contain large amounts of Mo and W. Accordingly, the content of Mo and the content of W in the interface between a martensite phase and a ferrite phase after the precipitates described above are dissolved are increased. Accordingly, it is considered that the interface between a martensite phase and a ferrite phase is strengthened so that toughness is enhanced. Precipitation temperatures at which $\chi$ phase and $M_{23}C_6$ precipitate can be obtained by carrying out an equilibrium phase diagram calculation or by carrying out quenching treatment at various temperatures and observing to confirm the presence or non-presence of $\chi$ phase and $M_{23}C_6$ in samples.

Example 1

Molten steel having a composition shown in table 1 is produced by a converter, and molten steel is cast into a billet (steel pipe raw material) by a continuous casting method, the billet is subjected to hot rolling in accordance with a Mannesmann-plug mill process so that a steel seamless pipe having an outer diameter of 273 mm and a wall thickness of 26.25 mm is obtained. A sample is cut out from the obtained steel seamless pipe, and quenching and tempering treatment are applied to the sample under the conditions shown in Table 2-1.

TABLE 1

| Steel type No. | C | Si | Mn | P | S | Cr | Ni | Mo | V | N | O | Al | Cu, W | Nb, Ti, B | mass % Ca, REM, Zr | $\chi$ phase precipitation temperature (° C.) | $M_{23}C_6$ precipitation temperature (° C.) | Remarks |
|---|---|---|---|---|---|---|---|---|---|---|---|---|---|---|---|---|---|---|
| A | 0.011 | 0.29 | 0.34 | 0.020 | 0.001 | 17.6 | 3.0 | 2.6 | 0.052 | 0.049 | 0.0023 | 0.019 | | | | 878 | 837 | Present invention steel |
| B | 0.032 | 0.26 | 0.22 | 0.007 | 0.001 | 17.2 | 3.9 | 1.9 | 0.050 | 0.064 | 0.0015 | 0.020 | W: 0.24 | | | 868 | 895 | Present invention steel |
| C | 0.023 | 0.18 | 0.33 | 0.012 | 0.001 | 17.6 | 3.8 | 2.4 | 0.054 | 0.052 | 0.0023 | 0.008 | | Nb: 0.071 | | 873 | 885 | Present invention steel |
| D | 0.018 | 0.28 | 0.29 | 0.017 | 0.001 | 17.4 | 2.6 | 3.3 | 0.055 | 0.027 | 0.0021 | 0.013 | | Ti: 0.064 | | 898 | 932 | Present invention steel |
| E | 0.020 | 0.16 | 0.34 | 0.020 | 0.001 | 17.5 | 3.8 | 1.9 | 0.051 | 0.041 | 0.0027 | 0.014 | | | Ca: 0.0029 | 828 | 863 | Present invention steel |
| F | 0.024 | 0.19 | 0.34 | 0.024 | 0.002 | 16.5 | 3.6 | 2.0 | 0.038 | 0.048 | 0.0027 | 0.015 | Cu: 1.3 | Ti: 0.02, B: 0.001 | | 850 | 879 | Present invention steel |
| G | 0.016 | 0.30 | 0.30 | 0.021 | 0.002 | 16.5 | 4.5 | 2.5 | 0.052 | 0.044 | 0.0033 | 0.020 | W: 1.1 | | Zr: 0.032 | 956 | 827 | Present invention steel |
| H | 0.022 | 0.17 | 0.31 | 0.012 | 0.001 | 16.9 | 3.7 | 2.5 | 0.059 | 0.055 | 0.0021 | 0.007 | | Nb: 0.071 | REM: 0.008 | 883 | 872 | Present invention steel |
| I | 0.033 | 0.22 | 0.38 | 0.018 | 0.001 | 17.0 | 3.4 | 2.1 | 0.058 | 0.061 | 0.0032 | 0.008 | Cu: 1.0 | B: 0.002 | Zr: 0.033 | 854 | 905 | Present invention steel |
| J | 0.026 | 0.25 | 0.31 | 0.021 | 0.001 | 17.0 | 3.2 | 0.4 | 0.061 | 0.057 | 0.0035 | 0.006 | | Nb: 0.057 | | — | 836 | Comparison example steel |
| K | 0.029 | 0.29 | 0.30 | 0.007 | 0.001 | 16.9 | 1.0 | 3.0 | 0.063 | 0.051 | 0.0026 | 0.019 | | | | 846 | 969 | Comparison example steel |

TABLE 1-continued

| Steel type No. | C | Si | Mn | P | S | Cr | Ni | Mo | V | N | O | Al | Cu, W | Nb, Ti, B | mass % Ca, REM, Zr | χ phase precipitation temperature (° C.) | $M_{23}C_6$ precipitation temperature (° C.) | Remarks |
|---|---|---|---|---|---|---|---|---|---|---|---|---|---|---|---|---|---|---|
| L | 0.032 | 0.20 | 0.27 | 0.019 | 0.001 | 16.6 | 3.8 | 2.4 | 0.049 | 0.043 | 0.0016 | 0.024 | Cu: 1.0, W: 1.0 | Nb: 0.077 | | 928 | 917 | Present invention steel |

Note:
the underlined indicates values which do not fall within the scope of the present invention.

A microstructure-observation-use specimen is cut out from the sample to which the quenching and tempering treatments have been applied in the manner shown above. A percentage of ferrite phase is obtained by the following method. The above-mentioned microstructure-observation-use specimen is etched with Vilella reagent, the microstructure is observed by a scanning-type electron microscope (SEM) at a magnification of 1000 times, and an area ratio (%) of ferrite phase measured using an image analysis device is defined as a volume ratio (%) of ferrite phase.

A percentage of the residual austenite structure is measured using an X-ray diffraction method. A measurement-use specimen is cut out from the sample to which the quenching and tempering treatments have been applied. Diffracted X-ray integral intensities of (220) plane of γ (gamma) and (211) plane of α (alpha) of the specimen are measured, and converted using the following formula (1)

$$\gamma(\text{volume ratio})=100/(1+(I\alpha R\gamma/I\gamma R\alpha)) \quad (1)$$

Iα: integral intensity of α, Rα: crystallographical theoretic calculation of α, Iγ: integral intensity of γ, Rγ: crystallographical theoretic calculation of γ

A percentage of martensite phase is calculated as a balance other than these phases.

A strip specimen 5CT specified by API standard is cut out from the sample to which the quenching and tempering treatments have been applied, and tensile characteristics (yield strength YS, tensile strength TS) are obtained by carrying out a tensile test in accordance with the API rule (American Petroleum Institute rule). Further, a V-notched test bar (thickness: 10 mm) is cut out from the sample to which the quenching and tempering treatments have been applied in accordance with JIS Z 2242, a Charpy impact test is applied to the V-notched test bar, and absorbed energy $vE_{-10}$ (J) at a temperature of −10° C. is obtained for evaluation.

Further, a corrosion specimen having a thickness of 3 mm, a width of 30 mm and a length of 40 mm is prepared from the sample to which the quenching and tempering treatments have been applied by machining, and a corrosion test is applied to the corrosion specimen.

The corrosion test is carried out under the condition that the specimen is soaked in 20 mass % NaCl aqueous solution (solution temperature: 230° C., $CO_2$ gas atmosphere of 100 atmospheric pressure) which is a test solution held in an autoclave, and a soaking period is set to 14 days. A weight of the specimen after the test is measured, and a corrosion rate is obtained by calculation based on the reduction of weight before and after the corrosion test.

Further, a round bar specimen having a diameter of 6.4 mm is prepared by machining from the sample to which the quenching and tempering treatments have been applied in accordance with NACE TM0177 Method A, and a stress corrosion cracking resistance test is carried out.

The stress corrosion cracking resistance test is carried out under the condition that a specimen is soaked in a test liquid: that is, an aqueous solution prepared by adding an acetic acid and sodium acetate to 20 mass % NaCl aqueous solution (solution temperature 20° C., $H_2S$: 0.1 atmospheric pressure, $CO_2$: 0.9 atmospheric pressure) and controlling a pH value to 3.5. A period during which the specimen is soaked in the test liquid is set to 720 hours. 90% of yield stress is applied to the specimen as an applied stress. The presence or non-presence of cracking is observed with respect to the specimen after the test.

The obtained result is shown in Table 2-1 and Table 2-2. Table 2-1 and Table 2-2 are parts of a continuous table.

TABLE 2-1

| | | Heat treatment 1 | | | | | | Heat treatment 2 | | | | | |
|---|---|---|---|---|---|---|---|---|---|---|---|---|---|
| | | Quenching | | | Tempering | | | Quenching | | | Tempering | | |
| Steel pipe No. | Steel type No. | Heating temperature (° C.) | Soaking time (min) | Cooling*1 | Heating temperature (° C.) | Soaking time (min) | Cooling | Heating temperature (° C.) | Soaking time (min) | Cooling*1 | Heating temperature (° C.) | Soaking time (min) | Cooling |
| 1 | A | 750 | 60 | Water cooling | 580 | 30 | Air cooling | 920 | 30 | Water cooling | 580 | 30 | Air cooling |
| 1-2 | A | — | — | — | — | — | — | 920 | 30 | Water cooling | 580 | 30 | Air cooling |
| 2 | B | 920 | 30 | Water cooling | 580 | 30 | Air cooling | 920 | 30 | Water cooling | 580 | 30 | Air cooling |
| 3 | C | 800 | 30 | Water cooling | 580 | 30 | Air cooling | 920 | 30 | Water cooling | 580 | 30 | Air cooling |
| 4 | D | 850 | 60 | Water cooling | 580 | 30 | Air cooling | 940 | 30 | Water cooling | 580 | 30 | Air cooling |

TABLE 2-1-continued

| | | Heat treatment 1 | | | | | | Heat treatment 2 | | | | | |
|---|---|---|---|---|---|---|---|---|---|---|---|---|---|
| | | Quenching | | | Tempering | | | Quenching | | | Tempering | | |
| Steel pipe No. | Steel type No. | Heating temperature (° C.) | Soaking time (min) | Cooling*1 | Heating temperature (° C.) | Soaking time (min) | Cooling | Heating temperature (° C.) | Soaking time (min) | Cooling*1 | Heating temperature (° C.) | Soaking time (min) | Cooling |
| 5 | E | 920 | 30 | Water cooling | — | — | — | 920 | 30 | Water cooling | 580 | 30 | Air cooling |
| 6 | F | 920 | 30 | Water cooling | 580 | 30 | Air cooling | 920 | 30 | Water cooling | 580 | 30 | Air cooling |
| 7 | G | 750 | 90 | Water cooling | 600 | 30 | Air cooling | 960 | 60 | Air cooling | 600 | 30 | Air cooling |
| 8 | H | 800 | 90 | Water cooling | 580 | 30 | Air cooling | 920 | 30 | Water cooling | 580 | 30 | Air cooling |
| 9 | I | 850 | 60 | Water cooling | 570 | 30 | Air cooling | 920 | 30 | Air cooling | 570 | 30 | Air cooling |
| 9-2 | I | — | — | — | — | — | — | 920 | 30 | Air cooling | 570 | 30 | Air cooling |
| 10 | J | 920 | 30 | Water cooling | — | — | — | 920 | 30 | Water cooling | 580 | 30 | Air cooling |
| 11 | K | 750 | 30 | Water cooling | 580 | 30 | Air cooling | 980 | 30 | Water cooling | 580 | 30 | Air cooling |
| 12 | L | 800 | 60 | Water cooling | 580 | 15 | Air cooling | 960 | 20 | Water cooling | 580 | 15 | Air cooling |
| 13 | L | — | — | — | — | — | — | 960 | 20 | Water cooling | 580 | 15 | Air cooling |

*1water cooling stop temperature: 100° C. or below

The underlined indicates values which do not fall within the scope of the present invention.

TABLE 2-2

| | | Microstructure after heat treatment | | Martensite grain size (μm) | Interface Mo content/average Mo content | Interface W content/average W content | Tensile characteristic | | | Toughness at low temperature $vE_{-10}$° C. (J) | Corrosion characteristic Corrosion rate (mm/y) | |
|---|---|---|---|---|---|---|---|---|---|---|---|---|
| Steel pipe No. | Steel type No. | Ferrite percentage (volume %) | Residual austenite percentage (volume %) | | | | Yield strength YS (MPa) | Tensile strength TS (MPa) | SSC resistance | | | Remarks |
| 1 | A | 25 | 7 | 4.6 | 3.1 | 3.3 | 845 | 1024 | Sufficient | 39 | 0.098 | Present invention example |
| 1-2 | A | 27 | 7 | 6.6 | 2.4 | 2.3 | 834 | 1017 | Sufficient | 23 | 0.082 | Comparison example |
| 2 | B | 17 | 16 | 4.5 | 2.5 | 2.4 | 841 | 953 | Sufficient | 112 | 0.109 | Present invention example |
| 3 | C | 25 | 14 | 5.3 | 3.2 | 3.2 | 884 | 1024 | Sufficient | 66 | 0.095 | Present invention example |
| 4 | D | 58 | 3 | 5.3 | 5.3 | 4.0 | 659 | 875 | Sufficient | 35 | 0.088 | Present invention example |
| 5 | E | 26 | 12 | 4.7 | 2.6 | 2.1 | 788 | 967 | Sufficient | 87 | 0.100 | Present invention example |
| 6 | F | 16 | 20 | 5.5 | 2.3 | 2.2 | 820 | 978 | Sufficient | 126 | 0.090 | Present invention example |
| 7 | G | 16 | 10 | 5.3 | 3.9 | 3.4 | 738 | 969 | Sufficient | 141 | 0.088 | Present invention example |
| 8 | H | 25 | 14 | 5.2 | 5.7 | 4.8 | 843 | 962 | Sufficient | 56 | 0.090 | Present invention example |
| 9 | I | 25 | 12 | 5.3 | 4.7 | 3.8 | 882 | 985 | Sufficient | 41 | 0.104 | Present invention example |
| 9-2 | I | 21 | 13 | 6.7 | 2.6 | 2.3 | 885 | 978 | Sufficient | 25 | 0.116 | Comparison example |
| 10 | J | 15 | 9 | 5.1 | 2.6 | 2.3 | 820 | 960 | Insufficient | 82 | 0.162 | Comparison example |

TABLE 2-2-continued

| Steel pipe No. | Steel type No. | Microstructure after heat treatment: Ferrite percentage (volume %) | Residual austenite percentage (volume %) | Martensite grain size (μm) | Interface Mo content/ average Mo content | Interface W content/ average W content | Tensile characteristic: Yield strength YS (MPa) | Tensile strength TS (MPa) | SSC resistance | Toughness at low temperature $vE_{-10}$° C. (J) | Corrosion characteristic Corrosion rate (mm/y) | Remarks |
|---|---|---|---|---|---|---|---|---|---|---|---|---|
| 11 | K | 50 | 0 | 4.9 | 3.1 | 3.1 | 570 | 898 | Insufficient | 95 | 0.141 | Comparison example |
| 12 | L | 23 | 5 | 5.3 | 3.9 | 3.6 | 857 | 978 | Sufficient | 80 | 0.107 | Present invention example |
| 13 | L | 29 | 5 | 8.2 | 2.3 | 2.4 | 865 | 982 | Sufficient | 11 | 0.109 | Comparison example |

In Table 1, steel type J and steel type K are steels for comparison, in which Mo and Ni respectively does not fall within the scope of the present invention. Table 2-1 shows the conditions of heat treatment performed. The quenching treatment or the quenching and tempering treatments performed first time are described in the column of heat treatment 1, and the final quenching and tempering treatments is described in the column of heat treatment 2. Steel pipes No. 1 to 4, No. 6 to 9 and Nos. 11 and 12 are steel pipes to which heat treatment of QTQT type where quenching and tempering treatment is performed twice are applied, the steel pipes Nos. 5 and 10 are steel pipes to which heat treatment of QQT type where only quenching is performed in the first-time heat treatment and quenching and tempering treatment is performed in the second-time (final) heat treatment is applied. The steel pipe No. 13 is a steel pipe of comparative example where quenching and tempering treatment is performed only one time.

All present invention examples provide excellent seamless pipes exhibiting high strength where yield strength is 758 MPa or more and tensile strength is 827 MPa or more, high toughness where $vE_{-10}$ absorbed energy at −10° C. is 30 J or more, and excellent corrosion resistance (carbonic acid gas corrosion resistance) in a high-temperature corrosion environment containing $CO_2$ and $Cl^-$ with a corrosion rate of 0.127 mm/y (year) or below, and further exhibiting excellent sulfide stress corrosion cracking resistance without cracks even in an atmosphere containing $H_2S$. On the other hand, the comparative examples which do not fall within the scope of the present invention exhibit several defects such as a defect that desired high strength cannot be obtained, a defect that the corrosion resistance is lowered, a defect that low-temperature toughness is deteriorated or a defect that sulfide stress corrosion cracking resistance is lowered.

The invention claimed is:

1. A high-strength stainless steel pipe having:

a composition containing by mass % 0.005 to 0.05% C, 0.05 to 1.0% Si, 0.2 to 1.8% Mn, 0.03% or less P, 0.005% or less S, 14 to 20% Cr, 1.5 to 10% Ni, 1 to 5% Mo, 0.5% or less V, 0.15% or less N, 0.01% or less 0, 0.002 to 0.1% Al, and Fe and unavoidable impurities as a balance, a thickness of 19.1 mm or more, a Charpy absorbed energy of 30 J or more at a temperature of −10° C., and a sulfide stress corrosion cracking resistance, wherein a specimen is not broken for 720 hours or more in a sulfide stress corrosion cracking test which is performed under a condition where a round bar specimen cut out from the high-strength stainless steel pipe conforming to a provision of a NACE-TM0177 Method A is soaked into an aqueous solution prepared by adding an acetic acid and sodium acetate to 20 mass % NaCl aqueous solution (in an atmosphere where a liquid temperature is 20° C., $H_2S$ is at 0.1 atm and $CO_2$ is at 0.9 atm) and controlling a pH value thereof to 3.5, and an applied stress is 90% of a yield stress, wherein the steel pipe has a microstructure containing ferrite and martensite, the martensite having an average grain size of 6.0 μm or below the ferrite and martensite forming a ferrite-martensite interface, wherein a content of Mo in the ferrite-martensite interface is three or more times as large as a content of Mo of the steel pipe, and wherein the composition further contains 3% or less W, and a content of W in the ferrite-martensite interface is three or more times as large as a content of W of the steel pipe.

2. The high-strength stainless steel pipe according to claim 1, comprising a composition further containing at least one group selected from the groups A to C consisting of:

Group A: from 3.5% or less Cu by mass %;

Group B: at least one selected from 0.5% or less Nb, 0.3% or less Ti and 0.01% or less B, by mass %; and Group C: at least one selected from 0.01% or less Ca, 0.01 or less REM and 0.2% or less Zr, by mass %.

* * * * *